US007549510B2

(12) United States Patent
Sakurai et al.

(10) Patent No.: US 7,549,510 B2
(45) Date of Patent: Jun. 23, 2009

(54) VEHICLE EXHAUST SYSTEM

(75) Inventors: Taisuke Sakurai, Shizuoka-ken (JP); Itsurou Hagiwara, Shizuoka-ken (JP)

(73) Assignee: Yamaha Hatsudoki Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 11/692,814

(22) Filed: Mar. 28, 2007

(65) Prior Publication Data

US 2007/0227808 A1 Oct. 4, 2007

(30) Foreign Application Priority Data

Mar. 29, 2006 (JP) ..... 2006-092334
Feb. 9, 2007 (JP) ..... 2007-031100

(51) Int. Cl.
*F01N 1/04* (2006.01)
*F01N 1/24* (2006.01)
*F01N 7/08* (2006.01)
*F01N 1/02* (2006.01)

(52) U.S. Cl. ..... 181/252; 181/249; 181/255; 181/256; 181/227

(58) Field of Classification Search ..... 181/227, 181/228, 247, 248, 249, 252, 255, 256; 180/309, 180/89.2, 296, 68.3
See application file for complete search history.

(56) References Cited

U.S. PATENT DOCUMENTS 700,785 A 5/1902 Kull
1,366,632 A 1/1921 Bjarne
1,756,916 A 4/1930 Stranahan
1,820,972 A 9/1931 Haas
1,844,105 A 2/1932 Schnell
1,853,429 A * 4/1932 Jackson ..... 181/255
1,991,014 A 2/1935 Compo
2,008,964 A * 7/1935 Mikulie ..... 181/255
2,035,500 A 3/1936 Nulty
2,065,343 A 12/1936 Mitchell et al.
2,115,128 A 4/1938 Starkweather et al.
2,150,530 A 3/1939 Warsing
2,234,612 A 3/1941 Petersen
2,239,549 A 4/1941 Chipley
2,512,155 A * 6/1950 Hill ..... 181/249
2,523,260 A 9/1950 Campbell
2,543,461 A * 2/1951 Latulippe ..... 181/252

(Continued)

FOREIGN PATENT DOCUMENTS

DE 3724087 A1 * 2/1989

(Continued)

OTHER PUBLICATIONS

European Search Report dated Jun. 22, 2007.

*Primary Examiner*—Edgardo San Martin
(74) *Attorney, Agent, or Firm*—Knobbe, Martens, Olson & Bear, LLP

(57) ABSTRACT

An exhaust system for a straddle-type vehicle that achieves miniaturization while meeting a demand for noise reducing characteristics. The exhaust system is connectable to an engine, and includes an exhaust pipe connectable to the engine and a silencer. The exhaust system further comprises a tail pipe inserted into the silencer 10. The silencer comprises an outer housing and an inner core accommodated in the outer housing. An air space is provided between the tail pipe and the inner core.

19 Claims, 7 Drawing Sheets

U.S. PATENT DOCUMENTS

| | | | | | |
|---|---|---|---|---|---|
| 2,575,233 | A | | 11/1951 | Gustave | |
| 2,609,886 | A | | 9/1952 | Cline | |
| 2,640,557 | A | * | 6/1953 | Gaffney | 181/256 |
| 2,730,188 | A | | 1/1956 | Bailey | |
| 2,784,797 | A | | 3/1957 | Bailey | |
| 2,788,078 | A | | 4/1957 | Reindl | |
| 3,710,891 | A | | 1/1973 | Flugger | |
| 3,786,791 | A | * | 1/1974 | Richardson | 123/65 EM |
| 3,982,605 | A | * | 9/1976 | Sneckenberger | 181/247 |
| 4,108,275 | A | | 8/1978 | Black et al. | |
| 4,192,402 | A | | 3/1980 | Nakagawa et al. | |
| 4,360,076 | A | * | 11/1982 | Suyama | 181/265 |
| 4,371,053 | A | * | 2/1983 | Jones | 181/249 |
| 4,580,656 | A | | 4/1986 | Fukuda | |
| 4,589,517 | A | | 5/1986 | Fukuda | |
| 4,595,073 | A | * | 6/1986 | Thawani | 181/265 |
| 4,598,790 | A | * | 7/1986 | Uesugi et al. | 181/252 |
| 4,601,168 | A | * | 7/1986 | Harris | 60/299 |
| 4,674,594 | A | * | 6/1987 | Jensen | 181/243 |
| 4,690,245 | A | * | 9/1987 | Gregorich et al. | 181/272 |
| 5,107,953 | A | | 4/1992 | Shimizu et al. | |
| 5,371,331 | A | | 12/1994 | Wall | |
| 5,509,947 | A | | 4/1996 | Burton | |
| 5,633,482 | A | * | 5/1997 | Erion et al. | 181/282 |
| 5,661,272 | A | | 8/1997 | Iannetti | |
| 5,663,537 | A | * | 9/1997 | Ko et al. | 181/228 |
| 5,892,186 | A | * | 4/1999 | Flugger | 181/252 |
| 5,902,970 | A | * | 5/1999 | Ferri | 181/249 |
| 5,962,821 | A | * | 10/1999 | Iannetti | 181/256 |
| 5,969,299 | A | * | 10/1999 | Yamaguchi et al. | 181/227 |
| 6,026,930 | A | * | 2/2000 | Ogisu et al. | 181/228 |
| 6,070,695 | A | * | 6/2000 | Ohtaka et al. | 181/282 |
| 6,260,659 | B1 | | 7/2001 | Takahashi et al. | |
| 6,540,046 | B1 | * | 4/2003 | Schuhmacher et al. | 181/231 |
| 6,571,910 | B2 | * | 6/2003 | Storm | 181/264 |
| 6,968,922 | B2 | * | 11/2005 | Kawamata et al. | 181/231 |
| 2002/0134614 | A1 | | 9/2002 | Chen | |
| 2003/0136607 | A1 | | 7/2003 | Kawamata et al. | |
| 2005/0161283 | A1 | * | 7/2005 | Emler | 181/249 |
| 2006/0219476 | A1 | * | 10/2006 | Southway et al. | 181/269 |

FOREIGN PATENT DOCUMENTS

| | | | | |
|---|---|---|---|---|
| DE | 40 06 438 | A1 | | 9/1990 |
| FR | 1 347 893 | A | | 1/1964 |
| GB | 2 041 083 | A | | 9/1980 |
| GB | 2 110 298 | A | | 10/1982 |
| GB | 2 158 878 | A | | 11/1985 |
| JP | 53 147142 | A | | 12/1978 |
| JP | 63 001714 | A | | 1/1988 |
| JP | 63001713 | A | * | 1/1988 |
| JP | 01 069709 | A | | 3/1989 |
| JP | 03264716 | A | * | 11/1991 |
| JP | 04081507 | A | * | 3/1992 |
| JP | 05026025 | A | * | 2/1993 |
| JP | 05280323 | A | * | 10/1993 |
| JP | 06117242 | A | * | 4/1994 |
| JP | 06173634 | A | * | 6/1994 |
| JP | 08-312324 | | | 11/1996 |
| JP | 08-312324 | A | | 11/1996 |
| JP | 2003-184541 | | | 7/2003 |

* cited by examiner

[Fig. 1]
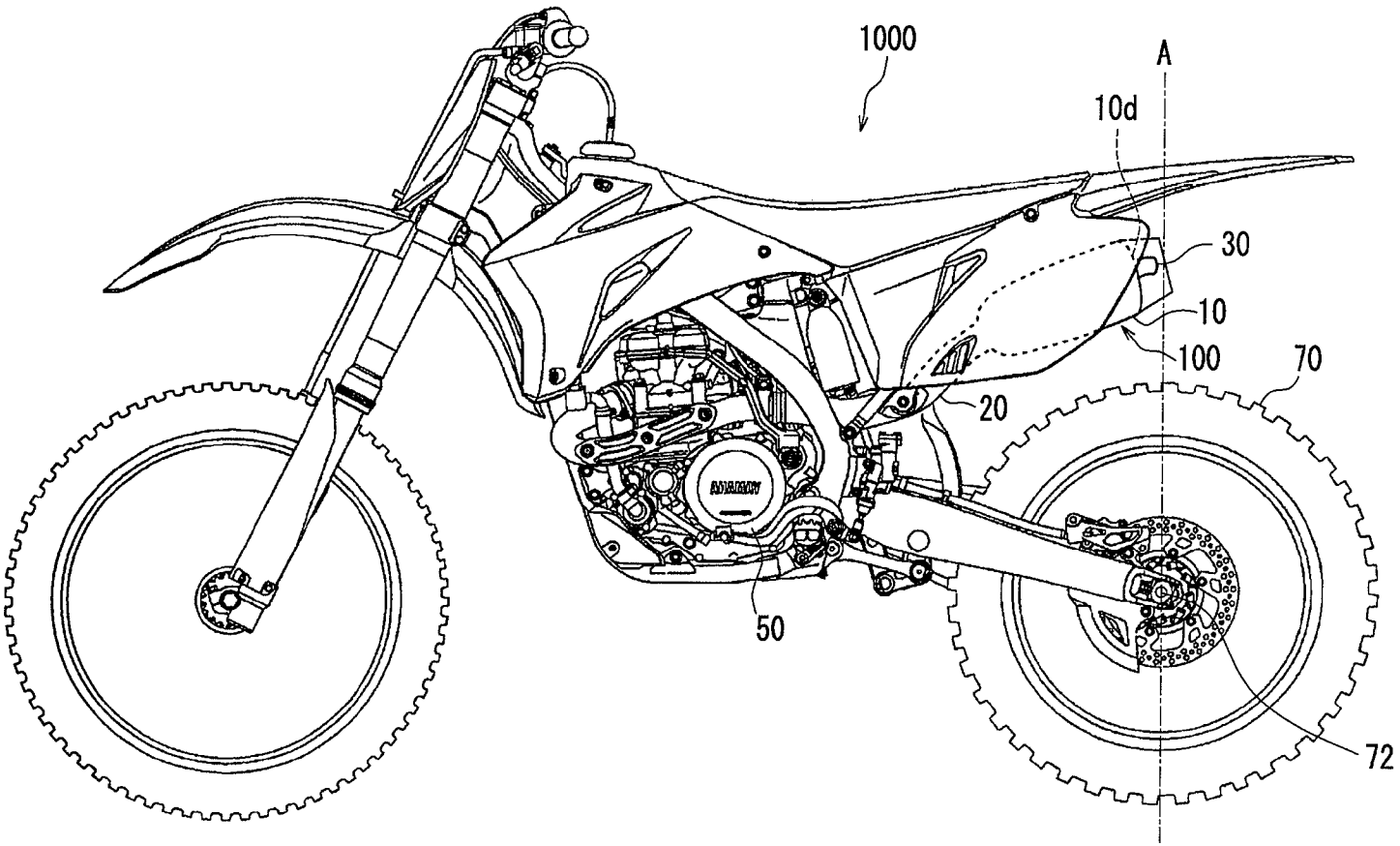

[Fig. 2]
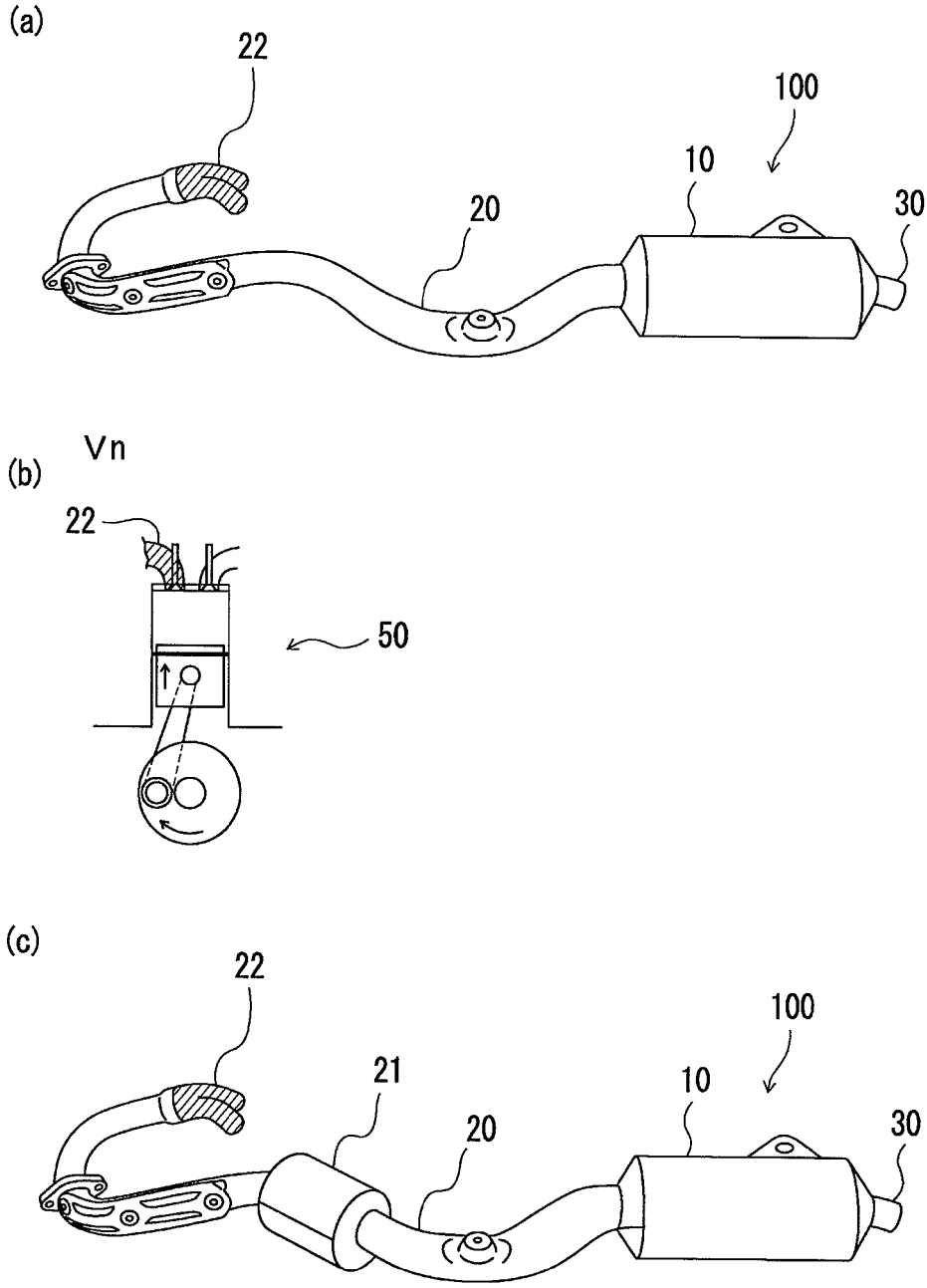

[Fig. 3]
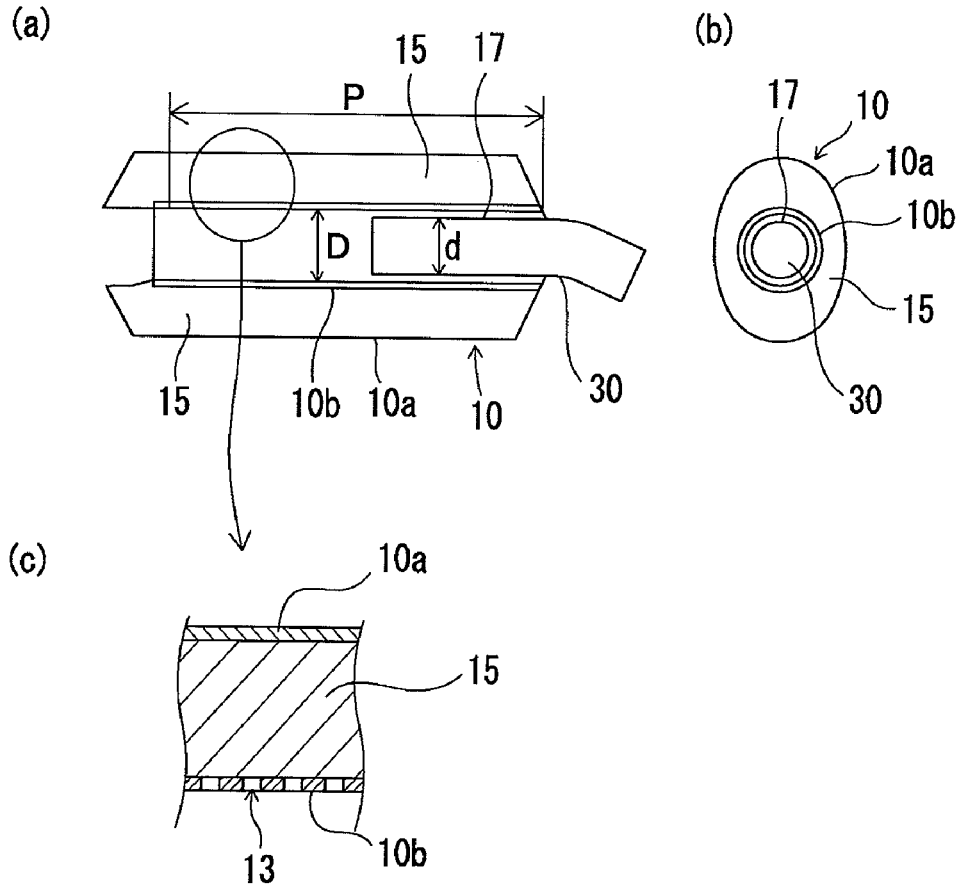

[Fig. 4]
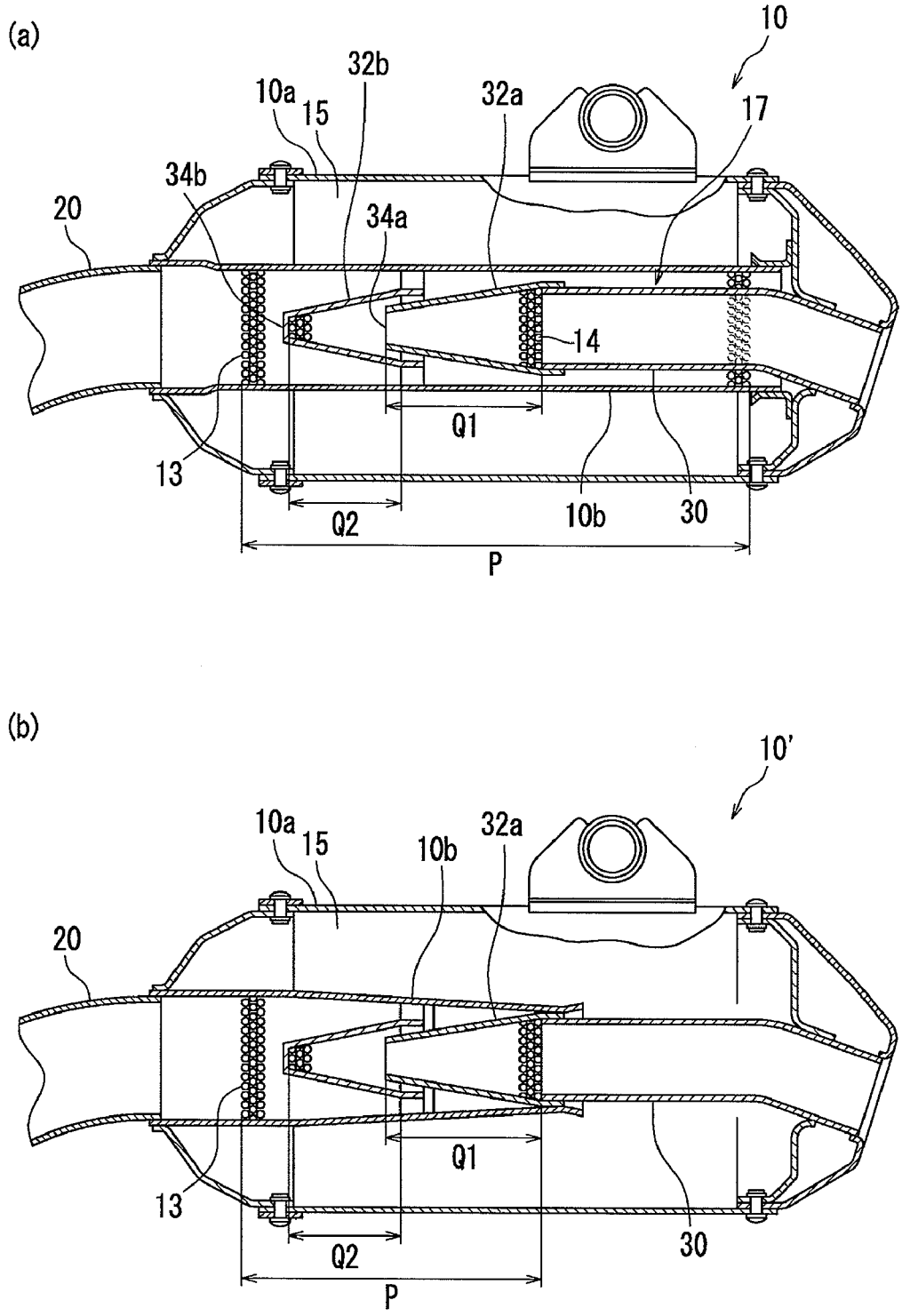

[Fig. 5]
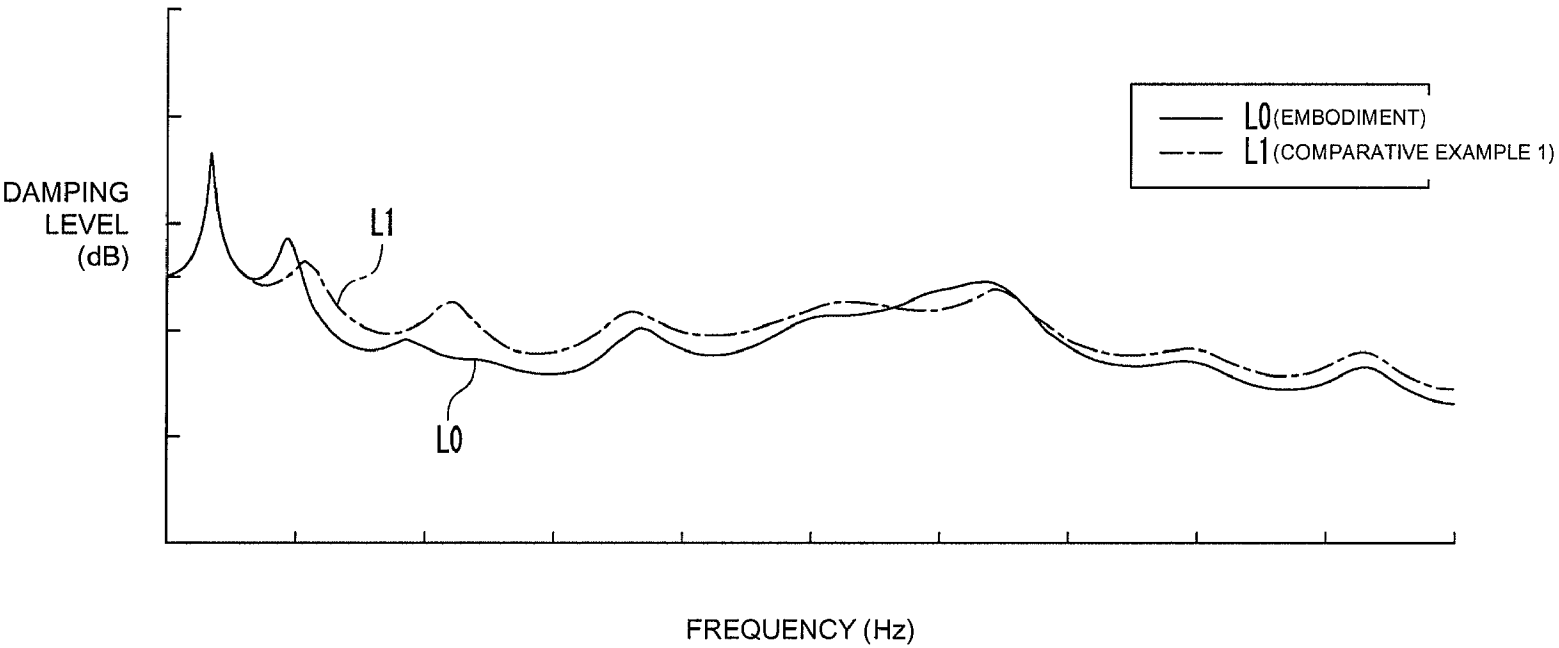

[Fig. 6]
(a)
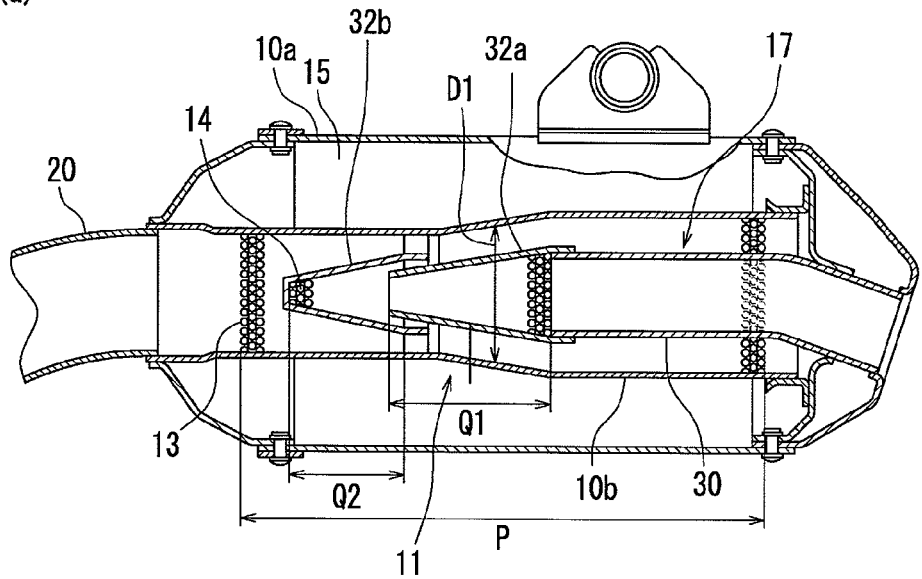
(b)
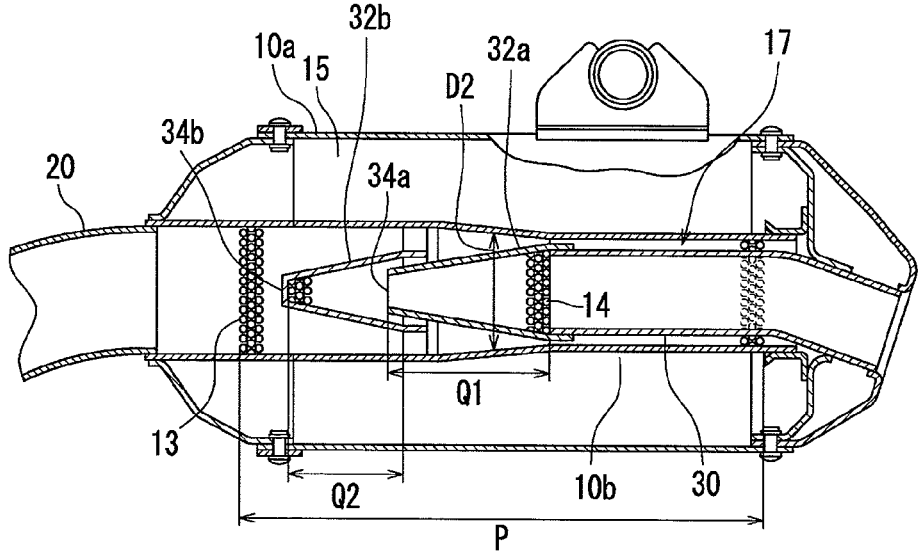

[Fig. 7]
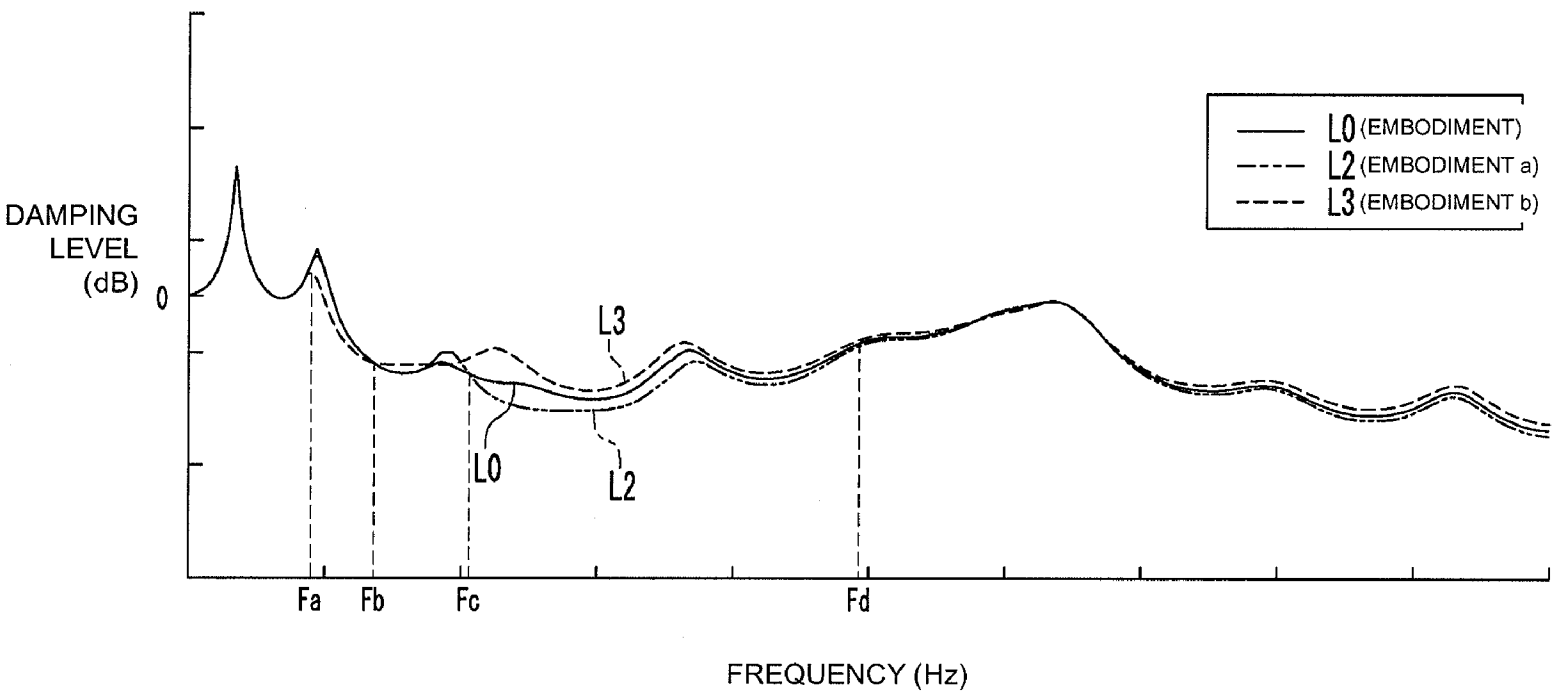

VEHICLE EXHAUST SYSTEM

RELATED APPLICATIONS

This application is related to, and claims priority from, Japanese Patent Application No. 2007-031100, filed Feb. 9, 2007 and Japanese Patent Application No. 2006-092334, filed Mar. 29, 2006, the entireties of which are hereby incorporated by reference herein and made a part of the present specification. application Ser. Nos. 11/692,824; 11/692,808; and 11/692,783, entitled VEHICLE EXHAUST SYSTEM, all filed on Mar. 28, 2007, are also incorporated by reference herein in their entireties and made a part of the present Specification.

BACKGROUND OF THE INVENTION

1. Field of the Invention

The present invention generally relates to an exhaust system for a vehicle. More particularly, the present invention relates to an exhaust system for a straddle-type vehicle and a straddle-type vehicle incorporating such an exhaust system.

2. Description of the Related Art

An exhaust system used in a straddle-type vehicle (for example, a motorcycle) is requested to meet two demands, that is, an exhaust efficiency, at which exhaust gases discharged from an engine should be efficiently discharged, and reduction of exhaust noise, which accompanies discharge of exhaust gases of high pressure and high temperature.

In particular, the demand for noise reduction or noise elimination has increased as noise regulations have been made more rigorous. Accordingly, it is increasingly desired that noise reduction or noise elimination be attained, while at the same time maintaining exhaust efficiency at desirable levels for performance reasons.

SUMMARY OF THE INVENTION

When design of an exhaust system is considered only in terms of exhaust efficiency, a muffler (exhaust system) is preferably extended straight. However, such an exhaust system is not well accommodated in a vehicle body of a motorcycle. Accordingly, in order to lessen an exhaust resistance, the exhaust system is extended toward the rear of a vehicle body in an attempt to avoid tight radius bends, which is difficult in many cases because of the front wheel of the motorcycle and a bank angle of the combustion chamber(s). Normally, a muffler having an ideal length in terms of engine performance is only seldom accommodated intact in a configuration of a motorcycle and, as compared with design of a muffler for four-wheel passenger cars, the design of a motorcycle exhaust system to meet both performance and physical constraints is significantly more challenging. That is, it is difficult in the context of a motorcycle exhaust system to achieve a length of the exhaust system that will both provide desired performance attributes and be accommodated within the space constraints of a motorcycle while maintaining a configuration that is as smooth as possible.

Also, not only an exhaust efficiency, but also a weight of a an exhaust system has a significant influence on the handling characteristics of a motorcycle. That is, because a motorcycle is relatively lightweight, even a weight of about one (1) kg has a great influence on the motorcycle. Moreover, because certain components of the exhaust system (e.g., the silencer) are usually located at a distance from a center of gravity of the motorcycle, the adverse influence of excess weight of the exhaust system on the handling characteristics of the motorcycle is increased.

On the other hand, in spite of any contrivance on a construction of the exhaust system, a certain silencer (or muffler) volume is needed to some extent to provide a noise reducing effect. In order to conform to regulations on noise, which are made increasingly rigorous, a silencer cannot but be made larger in many cases. Moreover, when a metallic sheet from which the silencer is constructed is thin, it vibrates thereby increasing noise. To avoid such a situation, the silencer is by all means liable to be relatively large in weight. An increase in the weight of the silencer results in undesired handling characteristics of the associated motorcycle.

In this manner, since a structure of an exhaust system for motorcycles is determined in terms of a variety of interrelated factors, it has been extremely difficult to realize an exhaust system in which miniaturization is achieved and a desired exhaust efficiency and noise-reduction characteristics are met.

Preferred embodiments of the present invention provide an exhaust system connectable to an engine. The exhaust system includes an exhaust pipe connected to the engine and a silencer connected to the exhaust pipe. The exhaust system further includes a tail pipe, at least a portion of which is inserted into the silencer. The silencer includes an outer housing and an inner core accommodated in the outer housing. An air space is provided between the tail pipe and the inner core.

A preferred embodiment involves an exhaust system as described above, wherein a sound absorbing material is positioned between an inner surface of the outer housing and an outer surface of the inner core.

A preferred embodiment involves an exhaust system as described above, wherein a radial dimension of at least a portion of the inner core gradually increases from a location spaced upstream from an upstream end of the tail pipe toward a location at the upstream end of the tail pipe.

A preferred embodiment involves an exhaust system as described above, wherein a radial dimension of at least a portion of the inner core gradually decreases from a location spaced upstream from an upstream end of the tail pipe toward a location at the upstream end of the tail pipe.

A preferred embodiment involves a straddle-type vehicle provided with the exhaust device as described in any of the preceding paragraphs.

A preferred embodiment involves a straddle-type vehicle described above, in which a downstream end of the inner cylinder of the silencer is located forward of an axis of an axle shaft of a rear wheel provided on the straddle-type vehicle.

A preferred embodiment involves a straddle-type vehicle, in which the straddle-type vehicle comprises a four-stroke engine.

A preferred embodiment involves a straddle-type vehicle, in which the straddle-type vehicle is an off-road motorcycle.

With the exhaust system according to the preferred embodiments of the invention, at least a portion of the tail pipe extends into the silencer, and the silencer includes an outer housing and an inner core accommodated in the outer housing. An air space is provided between the tail pipe and the inner core. In addition, a sound absorbing material is positioned between an inner surface of the outer housing and an outer surface of the inner core.

With a construction as described above, the provision of the air space makes it possible to appropriately adjust an outer housing effective cross sectional area (hence, a ratio of extension) while appropriately decreasing an amount of a sound absorbing material as filled and its combination (balance) can produce both effects of noise reduction by an expansion chamber principle and noise reduction by the sound absorbing material. Accordingly, it is possible to effectively produce an effect (noise reducing effect) of decreased exhaust noise, thus enabling an improvement in a damping characteristic of a muffler.

BRIEF DESCRIPTION OF THE DRAWINGS

These and other features, aspects and advantages of the present invention are described below with reference to drawings of preferred embodiments, which are intended to illustrate, but not to limit, the present invention. The drawings contain seven (7) figures.

FIG. 1 is a side view of a motorcycle including a muffler having certain features, aspects and advantages of the present invention.

FIG. 2(*a*) is a perspective view showing the muffler of the motorcycle of FIG. 1. FIG. 2(*b*) is a schematic view of an engine of the motorcycle of FIG. 1. FIG. 2(*c*) is a perspective view of a modification of the muffler of FIG. 2(*a*), wherein the muffler of FIG. 2(*c*) includes an expansion chamber.

FIG. 3 is a schematic view of a muffler according to an embodiment of the invention.

FIG. 4(*a*) is a cross sectional schematic view of the muffler of FIG. 3.

FIG. 4(*b*) is a cross sectional schematic view of a muffler of a comparative example 1.

FIG. 5 is a graph illustrating a comparison between a damping characteristic of a muffler of FIGS. 3 and 4(*a*) and a damping characteristic of the muffler of the comparative example 1 of FIG. 4(*b*).

FIGS. 6(*a*) and 6(*b*) are cross sectional views showing cross sectional structures of mufflers of an embodiment a and an embodiment b.

FIG. 7 is a graph showing a comparison in damping characteristic between the muffler of FIGS. 3 and 4(*a*) and the mufflers of the embodiment a and the embodiment b.

DETAILED DESCRIPTION OF THE PREFERRED EMBODIMENTS

While an exhaust system for a motorcycle is designed under various restrictions, conventional design philosophy is that a noise reducing effect cannot be actually produced unless the silencer is increased in volume. On the other hand, it is not possible to avoid a phenomenon in which an increase in volume of the silencer brings about an adverse affect on the handling characteristics of the motorcycle. In a muffler in, for example, present four-stroke motocross motorcycles (in particular, sports vehicles), a silencer is increased in volume whereby noise reduction and running performance are met, so that the muffler is large and heavy.

The present inventors have realize an exhaust device (muffler), which is small-sized and light while meeting performance criteria (exhaust property) and a noise characteristics. Embodiments of the invention are described below with reference to the drawings. In addition, the invention is not limited to the following embodiment.

FIG. 1 shows a motorcycle 1000, on which an exhaust system 100 according to a preferred embodiment of the invention is mounted. The exhaust system 100 is connected to an engine 50 of the motorcycle 1000. The exhaust system 100 includes an exhaust pipe 20 and a silencer 10. In addition, the exhaust system 100 including the silencer 10 is in some cases referred to as a "muffler" herein for the sake of convenience.

The muffler 100 includes the exhaust pipe 20 connected to the engine 50 of the motorcycle 1000, and the silencer 10 connected to the exhaust pipe 20. With a construction shown in FIG. 1, a tail pipe 30 is connected to the silencer 10.

A state, in which the muffler 100 is removed from the motorcycle 1000, is shown in FIG. 2(*a*) for convenience. The exhaust pipe 20 and the silencer 10 of the muffler 100 shown in FIG. 2(*a*) are formed with members for mounting to a vehicle body. The muffler 100 is one for four-stroke engines and the motorcycle 1000 shown in FIG. 1 is an off-road vehicle. In addition, that end of the exhaust pipe 20 shown in FIG. 2(*a*), which is connected to the engine 50, mounts to a cylinder head exhaust port 22 of the engine 50.

The exhaust pipe 20 connects to an exhaust opening of the engine 50, as shown in FIG. 2(*b*) to lead exhaust gases from the engine 50 to the silencer 10. In an example as shown, of the exhaust pipe 20 is connected to the engine 50 to communicate with the cylinder head exhaust port 22. The silencer 10 has a noise eliminating function to discharge exhaust gases led from the exhaust pipe 20 to the external environment. In the case where the tail pipe 30 is connected to the silencer 10, exhaust gases are discharged from the tail pipe 30. In addition, as shown in FIG. 2(*c*), an expansion chamber 21 can be provided in the exhaust pipe 20. In this case, exhaust gases from the engine 50 expand once in the chamber 21 and are then led to the silencer 10 to be discharged to the external environment.

FIG. 3 is a cross sectional view schematically showing a cross sectional structure of the silencer 10, into which exhaust gases are introduced. The silencer 10 according to the embodiment comprises an outer housing, or cylinder 10*a*, and an inner core, or cylinder 10*b*, accommodated in the outer cylinder 10*a*. Although the terms "cylinder" are used herein, the housing 10*a* and core 10*b* are not limited to circular cross sectional shapes. The term "cylinder" is used in a broad sense that can include non-circular cross sectional shapes, as well, including oval or rectangular shapes, for instance. Moreover, the cross section shape of the housing 10*a* and/or core 10*b* may vary throughout its length.

The inner cylinder 10*b* is a generally cylindrical-shaped member made of stainless steel. The inner cylinder 10*b* serves to lead exhaust gases, which are introduced into the silencer 10, to the tail pipe 30. Punched holes 13 are formed in at least a portion (here, region P) of the inner cylinder 10*b* of the silencer 10. The punched holes 13 are a collection of small holes formed in the silencer 10 (here, the inner cylinder 10*b*) and serve to enable energy of exhaust gases, which are introduced from the exhaust pipe 20, to be led to the outer cylinder 10*a* through the small holes. Although the term "punched holes" is used for convenience, the term includes holes produced by any suitable process or method.

A sound absorbing material 15 is positioned between an inner surface of the outer cylinder 10*a* and an outer surface of the inner cylinder 10*b* in a manner to come into close contact therewith. The sound absorbing material 15 is a material capable of absorbing sound waves and can include, for example, glass wool, stainless steel wool (SUS wool), aluminum wool, ferrite, etc. In this example, glass wool is used as the sound absorbing material 15. The sound absorbing material 15 fairly absorbs a high frequency sound (exhaust noise in a high frequency range).

Further, a tail pipe 30 is inserted into the silencer 10. In the illustrated arrangement, the tail pipe 30 is inserted to around a center of the silencer 10 from a downstream end of the silencer 10. The tail pipe 30 is a generally cylindrical-shaped member made of stainless steel and is generally circular in cross sectional shape. The tail pipe 30 serves to finally discharge exhaust gases, which flow into the silencer 10, to the external environment.

With the silencer 10 as illustrated, an air space or layer 17 is formed between the tail pipe 30 and the inner cylinder 10*b*.

Specifically, an outside diameter d of the tail pipe 30 is smaller than an inside diameter D of the inner cylinder 10*b* of the silencer 10. Thereby, exhaust gases introduced from the exhaust pipe can be led between the tail pipe 30 and the inner cylinder 10*b*. Further, the sound absorbing material 15 and punched holes (region P) are formed to extend to as far as a region (a region, in which the air layer 17 is positioned), in which the tail pipe 30 is positioned. Thereby, the sound absorbing material can absorb exhaust gases introduced into the air layer 17 between the tail pipe 30 and the inner cylinder 10*b*.

With the construction as described above, a ratio of extension (that is, outer-cylinder effective cross sectional area/tail-pipe cross section) of an outer-cylinder (drum portion) cross section and a tail-pipe cross section can be appropriately regulated whereby the muffler 100 can be improved in damping characteristics. Herein, the term "outer-cylinder effective cross sectional area" does not refer to an actual cross sectional area of the outer cylinder, but rather to an effective cross sectional area of that portion, which takes into account the provision of a sound absorbing material. For example, an outer-cylinder effective cross sectional area decreases when an apparent density of the sound absorbing material is high.

The muffler 100 according to the embodiment has a combined structure of noise reduction (expansion type) by expansion in the outer cylinder 10*a* and noise reduction (noise absorbing type) by the sound absorbing material 15. By providing the air layer 17 between the tail pipe 30 and the inner cylinder 10*b*, it is possible to appropriately regulate an outer-cylinder effective cross sectional area (hence, ratio of extension) while appropriately decreasing an amount of a sound absorbing material 15 provided, thus enabling producing both effects of noise reduction by expansion and noise reduction by the sound absorbing material owing to its combination (balance). Accordingly, it is possible to effectively produce an effect (noise reducing effect) of a decrease in exhaust noise, thus enabling an improvement in a damping characteristic of the muffler 100.

In addition, the structure of the muffler 100 can be preferably used in a small-sized muffler, in which a miniaturization and lightening are achieved. "Small-sized muffler" referred to herein is the muffler 100 having a straight pipe structure arranged forwardly of an axis of an axle shaft 72 of a rear wheel 70, similar to the motorcycle 1000 shown in FIG. 1. In this example, a downstream end 10*d* of the silencer 10 is positioned forwardly of a perpendicular line A extended from the axis of the axle shaft 72 of the rear wheel 70 in a vertical direction. In this manner, a muffler, in which a downstream end of a silencer is positioned forward of an axle shaft of a rear wheel, involves a conventional problem that the silencer is short in lengthwise dimension and that not much of a noise reducing effect due to pressure loss can be expected. In contrast, with a muffler structure according to one of the preferred embodiments is adopted, even the small-sized muffler as shown in FIG. 1 can effectively combine effects of noise reduction by expansion and noise reduction by the sound absorbing material, thus permitting a desirable damping characteristic of the muffler to be achieved.

The downstream end 10*d* of the silencer 10 more specifically corresponds to a downstream end of the inner cylinder 10*b* provided in the silencer. Accordingly, for example, even when a part of the tail pipe 30 connected to the silencer 10 is positioned rearwardly of the axle shaft 72 of the rear wheel 70, the structure corresponds to "small-sized muffler" referred herein to. Also, the muffler structure according to the embodiment is not limited to the muffler of the type shown in FIG. 1 but can be appropriately used in a muffler of a so-called "cruiser" type motorcycle.

In addition, "upstream" side and "downstream" side referred to in the specification of the present application mean an upstream side and a downstream side, respectively, in a direction, in which exhaust gases in the muffler flow. In other words, "upstream" side is that side, on which an engine is arranged, and "downstream" side is that side, on which exhaust gases are discharged.

Further, an internal construction of the silencer 10 according to the embodiment is described in greater detail with reference to FIGS. 4(*a*) and 4(*b*). FIG. 4(*a*) is a view showing the internal construction of the silencer 10 according to a preferred embodiment of the present invention and FIG. 4(*b*) is a view showing an internal construction of a muffler 10' of a comparative example 1.

The silencer 10 can produce a noise reducing effect owing not only to noise reduction by expansion and noise reduction by the sound absorbing material, but also to other various means as means for an improvement in the damping characteristic of the muffler 100. For example, the example shown in FIG. 4(*a*) adopts a construction, in which one or more generally conical members, generally 32, are arranged in the silencer 10. The conical member 32 comprises a member made of, for example, stainless steel and being in the form of a cone, the member being formed in a region Q on a cone-shaped side thereof with punched holes 14. The conical member 32 can also produce a noise reducing effect to reduce noise (for example, directly transmitting sound) mainly in a high frequency range. One or more conical members 32 can be arranged within the silencer 10. Here, the conical members 32 are provided in two locations (32*a*, 32*b*) on the inner cylinder 10*b* and an upstream end of the tail pipe 30. The construction described above can incorporate a noise reducing effect by the conical members 32 in addition to the noise reducing effect by expansion and by the sound absorbing material, and such a combination (balance) makes it possible to regulate the damping characteristic of the muffler 100.

Below, an explanation is provided as to effects that the structure of the muffler 100 have on a damping characteristic of the muffler 100, making a comparison between the embodiment of FIG. 4(*a*) and the comparative example 1 of FIG. 4(*b*).

A silencer 10' of the comparative example 1 shown in FIG. 4(*b*) is different from the embodiment of FIG. 4(*a*) primarily in the structure of the air layer 17 of the silencer 10. Specifically, while the air layer 17 is provided between the tail pipe 30 and the inner cylinder 10*b* in the preferred embodiments, a similar air layer is not provided in the silencer 10' of the comparative example 1, and the inner cylinder 10*b* is gradually decreased in an inside diameter from a location spaced upstream from a front end of the tail pipe 30 up to location at the front end of the tail pipe 30.

FIG. 5 shows a comparison in damping characteristic between the both silencers. In FIG. 5, the X-axis, or horizontal axis, indicates frequency (Hz), the Y-axis, or vertical axis, indicates a damping level (dB) (also called a sound pressure level), and a small damping level in the same frequency means that a damping characteristic becomes favorable (that is, a noise value lowers). Line "L0" indicates a damping characteristic in the embodiment of FIG. 4(*a*) and Line "L1" indicates a damping characteristic in the comparative example 1 of FIG. 4(*b*).

When a comparison is made between Line "L0" and Line "L1", it is found that Line "L0" is wholly smaller in damping level (sound pressure level) than Line "L1". In other words, the silencer 10 according to the preferred embodiment becomes low in noise value as compared with the silencer 10' of the comparative example 1. The reason why the embodiment is small in noise value as compared with the comparative example 1 is due to the construction in which the air layer 17 is provided between the tail pipe 30 and the inner cylinder 10*b*. That is, according to the preferred embodiment of FIG. 4(*a*), it has been determined that by providing the air layer 17, it is possible to appropriately regulate an outer-cylinder effective cross sectional area (hence, ratio of extension) while appropriately decreasing an amount of a sound absorbing material as filled, thus enabling improving a damping characteristic of the muffler owing to both effects of noise reduction by expansion and by the sound absorbing material.

In addition, while the inner cylinder 10*b* in the example described above is shaped such that an inner wall thereof is extended straight, this is not limitative but it is possible to incorporate a damping characteristic, in which noise is eliminated by varying a cross sectional area of the inner cylinder 10*b* (inside diameter of the inner cylinder 10*b*). By varying an inside diameter of the inner cylinder 10*b*, it is possible to regulate a ratio of the sound absorbing material 15 and the air layer 17, thereby permitting a desired damping characteristic to be obtained. That a desired damping characteristic can be obtained by a change of the inner cylinder diameter is described in addition to a further embodiment (FIG. 6) and a graph of a damping characteristic (FIG. 7) of that embodiment. FIG. 6(*a*) shows an internal construction of a silencer according to an embodiment a and FIG. 6(*b*) shows an internal construction of a silencer according to an embodiment b. In addition, the silencers according to the embodiment a and the embodiment b are different only in the structure of an inner cylinder 10*b* from the silencer 10 according to the embodiment of FIG. 4(*a*). Accordingly, the same constituent members are denoted by the same reference numerals and a duplicate explanation therefore is omitted.

According to the embodiment a in FIG. 6(*a*), an inner diameter "D1" about a center of the inner cylinder 10*b* is gradually enlarged from a location spaced forward of an upstream end of the tail pipe 30 up to a location at the upstream end of the tail pipe 30 (that is, there is provided a portion that increases in inner diameter "D1" from an upstream end of the portion to a downstream end of the portion). Thereby, the air layer 17 is increased in ratio as compared with the embodiment of FIG. 4(*a*), while the sound absorbing material 15 is decreased in ratio. On the other hand, according to the embodiment b in FIG. 6(*b*), an inner diameter "D2" about a center of the inner cylinder 10*b* gradually decreases from a location spaced forward of the upstream end of the tail pipe 30 up to a location at the upstream end of the tail pipe 30 (that is, there is provided a portion that increases in inner diameter "D2" from an upstream end of the portion to a downstream end of the portion). Thereby, the air layer 17 is decreased in ratio as compared with the embodiment of FIG. 4(*a*), while the sound absorbing material 15 is increased in ratio.

FIG. 7 shows a comparison in damping characteristic between these silencers. Line "L0" indicates a damping characteristic in the embodiment of FIG. 4(*a*), Line "L2" indicates a damping characteristic in the embodiment a of FIG. 6(*a*), and Line "L3" indicates a damping characteristic in the embodiment b of FIG. 6(*b*). When a comparison is made among Line "L0", Line "L2", and Line "L3", a phenomenon occurs that a damping level (sound pressure level) is reversed in a specified frequency range. Specifically, while a damping level (sound pressure level) decreases in the order (that is, in that order, in which the air layer 17 is increased in ratio) of Line "L2", Line "L0", and Line "L3" in a frequency range in the vicinity of "Fc(Hz) to Fd(Hz)", a damping level decreases in a reverse order (that is, in that order, in which the air layer 17 is decreased in ratio) to the above order in a frequency range "Fa(Hz) to Fb(Hz)". Such difference in damping characteristic is due to a difference in shape of the inner cylinder (an inside diameter is increased, decreased, and not varied), and hence a difference in ratio between the air layer 17 and the sound absorbing material 15.

This phenomenon is made use of to enable a selective decreasing of a noise component in a specific frequency range. That is, a damping characteristic in a desired frequency range can be made favorable by appropriately adjusting a ratio of the air layer 17 and the sound absorbing material 15 owing to a change in inner cylinder diameter. For example, in the case where it is desired that a noise component in a frequency range "Fc(Hz) to Fd(Hz)" be decreased, it suffices to increase a ratio of the air layer 17 through an increase in inner cylinder diameter as in the embodiment a of FIG. 6(*a*) (hence, it suffices to decrease an amount of the sound absorbing material 15 as filled). n the case where it is desired that a noise component in a frequency range "Fa(Hz) to Fb(Hz)" be decreased, it suffices to decrease a ratio of the air layer 17 through a decrease in inner cylinder diameter as in the embodiment b of FIG. 6(*b*) (hence, it suffices to increase an amount of the sound absorbing material 15 as filled). In this manner, a preferred shape of the inner cylinder 10*b* can be selected in conformity to a demanded noise eliminating performance (a desired frequency range, in which it is desirable to decrease a damping level) of the muffler.

According to the preferred embodiments of the present invention, the exhaust system comprises the tail pipe 30 inserted into the silencer 10 and the silencer 10 comprises the outer cylinder 10*a* and the inner cylinder 10*b* accommodated in the outer cylinder 10*a*. The air layer 17 is provided between the tail pipe 30 and the inner cylinder 10*b*. Also, the sound absorbing material 15 is positioned between an inner wall of the outer cylinder 10*a* and an outer wall of the inner cylinder 10*b* in the silencer 10.

With the construction described above, the provision of the air layer 17 makes it possible to appropriately adjust an outer-cylinder effective cross sectional area (hence, a ratio of extension) while appropriately decreasing an amount of the sound absorbing material 15 as filled and its combination (balance) can produce both effects of noise reduction by expansion and noise reduction by the sound absorbing material. Accordingly, it is possible to effectively produce an effect (noise reducing effect) of decreasing exhaust noise, thus permitting an improvement in a damping characteristic of a muffler.

Further, by making an inside diameter of the inner cylinder 10*b* appropriately variable (for example, the inner diameter "D1" of the inner cylinder 10*b* is gradually increased toward a position at an upstream end of the tail pipe 30 as shown in FIG. 6(*a*), or the inner diameter "D2" of the inner cylinder 10*b* is gradually decreased toward a position at the upstream end of the tail pipe 30 as shown in FIG. 6(*b*)), it is possible to appropriately adjust a ratio of the air layer 17 and the sound absorbing material 15, thereby permitting a damping characteristic in a desired frequency range to be made favorable.

In addition, the constructions described above can be preferably used in a small-sized muffler (for example, a muffler arranged forwardly of an axle shaft 72 of a rear wheel 70), in which typical miniaturization and lightening are achieved. Even such small-sized muffler can effectively combine effects of noise reduction by expansion and by the sound absorbing material, thus permitting the desired noise damping characteristics to be met.

In addition, while FIG. 1 shows an off-road motorcycle as an example of the motorcycle 1000, the motorcycle 1000 may be an on-road motorcycle as well. Also, "motorcycle" in the specification of the present application means a motorcycle and also means a vehicle, which includes a bicycle with a motor (motorbike) and a scooter and that can specifically turn with a vehicle body inclined. Accordingly, a three-wheeler-four-wheeler, at least one of a front wheel and a rear wheel of which has two or more wheels and which is three, four (or more) in the number of tires, can be included within the scope of the term "motorcycle". In addition, applicability is not limited to a motorcycle but to other vehicles capable of making use of the effect of the invention, for example, a so-called straddle-type vehicle, which includes a four-wheeled buggy, ATV (All Terrain Vehicle), a snowmobile, and other similar vehicles in addition to a motorcycle.

While the invention has been described with respect to preferred embodiments, such descriptions are not limitative but various modifications are of course possible. According to the preferred embodiments of the present invention, it is possible to provide a muffler for a straddle-type vehicle, which achieves miniaturization while meeting a demand for a noise eliminating characteristic.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In particular, while the present exhaust system and vehicle incorporating the exhaust system have been described in the context of particularly preferred embodiments, the skilled artisan will appreciate, in view of the present disclosure, that certain advantages, features and aspects of the system may be realized in a variety of other applications, many of which have been noted above. Additionally, it is contemplated that various aspects and features of the invention described can be practiced separately, combined together, or substituted for one another, and that a variety of combination and subcombinations of the features and aspects can be made and still fall within the scope of the invention. Thus, it is intended that the scope of the present invention herein disclosed should not be limited by the particular disclosed embodiments described above, but should be determined only by a fair reading of the claims.

What is claimed is:

1. An exhaust system, comprising:

an exhaust pipe connectable to an engine of a vehicle;

a silencer coupled to the exhaust pipe, wherein the silencer comprises an outer housing and an inner core accommodated within the outer housing, wherein the exhaust pipe is aligned with the inner core at a junction therebetween;

a tail pipe arrangement coupled to the silencer, at least a portion of the tail pipe arrangement extending within the silencer, wherein the tail pipe arrangement and the inner core overlap one another along a longitudinal axis of the silencer to define an overlap portion, wherein the radial dimension of an intermediate section of the inner core gradually changes within the overlap portion; and an air space between the tail pipe and the inner core.

2. The exhaust system of claim 1, wherein a sound absorbing material is positioned between an inner surface of the outer housing and an outer surface of the inner core.

3. The exhaust system of claim 1, wherein a radial dimension of at least a portion of the inner core gradually increases from a location spaced upstream from an upstream end of the tail pipe arrangement toward a location at the upstream end of the tail pipe arrangement.

4. The exhaust system of claim 1, wherein a radial dimension of at least a portion of the inner core gradually decreases from a location spaced upstream from an upstream end of the tail pipe arrangement toward a location at the upstream end of the tail pipe arrangement.

5. A straddle-type vehicle, comprising:

an engine comprising at least one combustion chamber;

an exhaust pipe connected to the engine and in communication with the at least one combustion chamber;

a silencer coupled to the exhaust pipe, wherein the silencer comprises an outer housing and an inner core accommodated within the outer housing, wherein the exhaust pipe is aligned with the inner core at a junction therebetween;

a tail pipe arrangement coupled to the silencer, at least a portion of the tail pipe arrangement extending within the silencer, wherein the tail pipe arrangement and the inner core overlap one another along a longitudinal axis of the silencer to define an overlap portion, wherein a radial dimension of an intermediate section of the inner core gradually changes within the overlap portion; and an air space between the tail pipe and the inner core.

6. The straddle-type vehicle of claim 5, wherein a downstream end of the silencer is located forward of an axis of an axle shaft of a rear wheel provided on the straddle-type vehicle.

7. The straddle-type vehicle of claim 5, wherein the engine operates on a four-stroke combustion principle.

8. The straddle-type vehicle of claim 5, wherein the straddle-type vehicle is an off-road motorcycle.

9. The straddle-type vehicle of claim 5, wherein a sound absorbing material is positioned between an inner surface of the outer housing and an outer surface of the inner core.

10. The straddle-type vehicle of claim 5, wherein a radial dimension of at least a portion of the inner core gradually increases from a location spaced upstream from an upstream end of the tail pipe arrangement toward a location at the upstream end of the tail pipe arrangement.

11. The straddle-type vehicle of claim 5, wherein a radial dimension of at least a portion of the inner core gradually decreases from a location spaced upstream from an upstream end of the tail pipe arrangement toward a location at the upstream end of the tail pipe arrangement.

12. The exhaust system of claim 1, wherein the tail pipe arrangement comprises a tail pipe and a conical member coupled to an end of the tail pipe within the silencer.

13. The exhaust system of claim 12, wherein the conical member is aligned with the gradually changing radial dimension portion of the inner core.

14. The exhaust system of claim 13, wherein the radial dimension of the conical member changes in the same direction as the gradually changing radial dimension portion of the inner core.

15. The exhaust system of claim 13, wherein the radial dimension of the conical member changes in the opposite direction as the gradually changing radial dimension portion of the inner core.

16. The exhaust system of claim 5, wherein the tail pipe arrangement comprises a tail pipe and a conical member coupled to an end of the tail pipe within the silencer.

17. The exhaust system of claim 16, wherein the conical member is aligned with the gradually changing radial dimension portion of the inner core.

18. The exhaust system of claim 17, wherein the radial dimension of the conical member changes in the same direction as the gradually changing radial dimension portion of the inner core.

19. The exhaust system of claim 17, wherein the radial dimension of the conical member changes in the opposite direction as the gradually changing radial dimension portion of the inner core.

* * * * *